US008757769B2

(12) United States Patent
Ohnishi

(10) Patent No.: US 8,757,769 B2
(45) Date of Patent: Jun. 24, 2014

(54) IMAGE FORMING APPARATUS

(71) Applicant: Masashi Ohnishi, Kanagawa (JP)

(72) Inventor: Masashi Ohnishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/690,099

(22) Filed: Nov. 30, 2012

(65) Prior Publication Data

US 2013/0141493 A1 Jun. 6, 2013

(30) Foreign Application Priority Data

Dec. 2, 2011 (JP) ..... 2011-265307

(51) Int. Cl.
*B41J 2/165* (2006.01)

(52) U.S. Cl.
USPC ..... 347/36

(58) Field of Classification Search
USPC ..... 347/36, 30, 23, 29, 7, 8, 85, 89; 439/10, 439/12, 13; 315/77–84; 362/459–549; 340/425–492; 116/28 R–28 A
See application file for complete search history.

(56) References Cited

U.S. PATENT DOCUMENTS 5,947,531 A * 9/1999 Eckard et al. ..... 285/319
2009/0315943 A1* 12/2009 Ohnishi et al. ..... 347/36
2010/0165040 A1 7/2010 Ohnishi et al.

FOREIGN PATENT DOCUMENTS

JP 2010-664 1/2010

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

An image forming apparatus includes a recording head, a waste liquid receiving member, a waste liquid tank, a needle member that is connected to the waste liquid receiving member and includes a needle part that is detachably inserted into the waste liquid tank, and a fastening member that detachably fastens the needle member. The fastening member includes a lock part that locks the needle member; the needle member includes a lock lever part that locks with the lock part of the fastening member; the needle member and the fastening member include fitting parts that fit together when the needle member is rotated; and by rotating the needle member, the lock lever is locked with the lock part, the fitting parts of the needle member and the fastening member are fit together, and the needle member is fastened to the fastening member.

5 Claims, 20 Drawing Sheets

IMAGE FORMING APPARATUS

BACKGROUND OF THE INVENTION

1. Field of the Invention

The disclosures herein relate generally to an image forming apparatus, and particularly to an image forming apparatus that includes a waste liquid tank.

2. Description of the Related Art

An image forming apparatus of a printer, a facsimile machine, a copier, a plotter, or a multifunction peripheral (MFP) combining one or more of the above functions may be an inkjet recording apparatus, which is a liquid discharge type image forming apparatus that uses a recording head made of a liquid discharge head (liquid droplet discharge head) that discharges liquid droplets, for example.

Such an image forming apparatus may include a maintenance unit for maintaining and restoring the recording head. Maintenance operations may be performed in the image forming apparatus by discharging liquid for purposes unrelated to image formation at a predetermined timing into a waste liquid receiving member such as a cap member or an idle discharge receiving unit. The liquid discharged into the waste liquid receiving member during such maintenance operations may be discharged from the waste liquid receiving member into a waste liquid tank via a waste liquid tube and a needle member (e.g., see Japanese Laid-Open Patent Publication No. 2010-000664).

When such a maintenance unit is to be replaced, or when the waste liquid tank is to be replaced, for example, the needle member is detached from the waste liquid tank and then reinserted into the existing waste liquid tank or inserted into a new waste liquid tank.

It is noted that the needle member needs to be securely fastened since the needle member has to maintain a sealed structure of the waste liquid tank. In a case where the needle member is fastened using a screw, detaching and attaching the needle member to/from the waste liquid tank may be burdensome. On the other hand, in a case where the needle member is snap-fit to the waste liquid tank, the engagement may be loose since such a fastening structure contemplates detachment and accurate positioning of the needle member and the sealed structure of the waste liquid tank may be difficult.

SUMMARY OF THE INVENTION

It is a general object of at least one embodiment of the present invention to provide an image forming apparatus that substantially obviates one or more problems caused by the limitations and disadvantages of the related art.

In one embodiment of the present invention, an image forming apparatus includes a recording head that discharges liquid droplets; a waste liquid receiving member that receives waste liquid that is discharged from the recording head for purposes unrelated to image formation; a waste liquid tank that accommodates the waste liquid received by the waste liquid receiving member; a needle member that is connected to the waste liquid receiving member and includes a needle part that is detachably inserted into the waste liquid tank; and a fastening member that is configured to detachably fasten the needle member; wherein the fastening member includes a lock part that locks the needle member; the needle member includes a lock lever part that locks with the lock part of the fastening member; the needle member and the fastening member include fitting parts that fit together when the needle member is rotated; and by rotating the needle member, the lock lever is locked with the lock part, the fitting parts of the needle member and the fastening member are fit together, and the needle member is fastened to the fastening member.

According to one aspect of the present invention, the needle member may be easily detached, and the needle member may be fastened without loosening.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention are described with reference to the accompanying drawings.

First, an image forming apparatus according to a first embodiment of the present invention is described below with reference to FIGS. 1-3.

Figure 1:
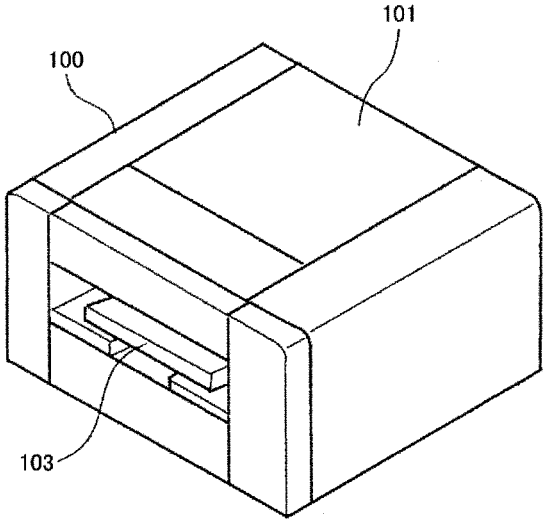
FIG. 1 is a perspective view of an image forming apparatus according to a first embodiment of the present invention.

FIG. 1 is a perspective view of the image forming apparatus; FIG. 2 is a plan view of a mechanical part of the image forming apparatus; and FIG. 3 is a side view of a carriage portion of the image forming apparatus.

The illustrated image forming apparatus is a serial-type image forming apparatus that includes an apparatus main frame 100 and a cover 101 that can be opened and closed arranged on the top side of the main frame 100. By opening the cover 101, the mechanical part arranged inside the main frame 100 may be exposed.

Figure 2:
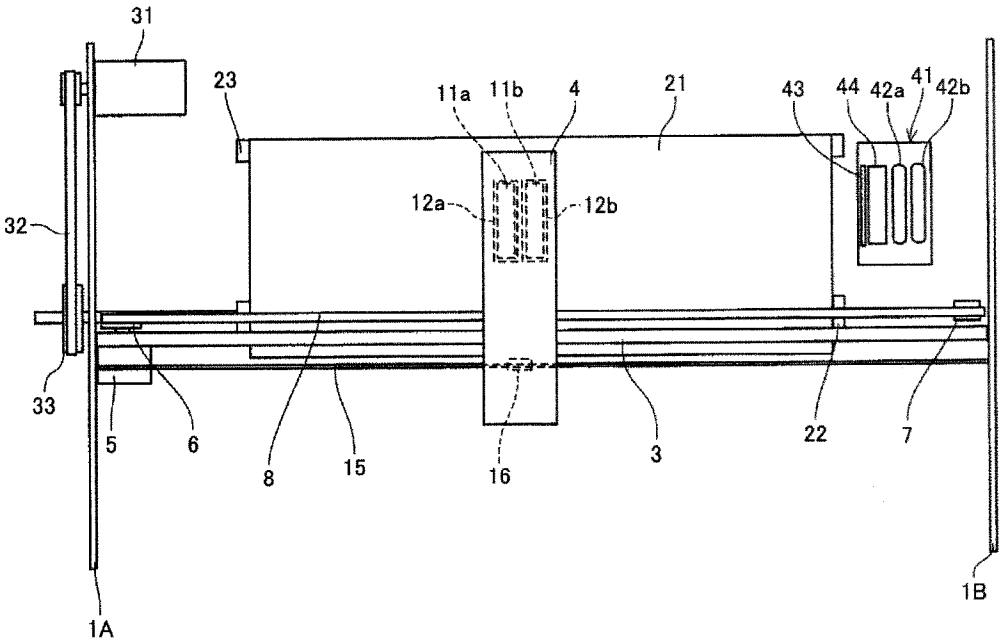
FIG. 2 is a plan view of a mechanical part of the image forming apparatus.

As is shown in FIG. 2, the mechanical part of the image forming apparatus has a carriage 4 supported by a guide member 3, which is a plate member that is suspended between side plates 1A and 1B. The carriage 4 may be moved in a main scanning direction by a main scanning motor 5 via a timing belt 8 that is stretched across a drive pulley 6 and a driven pulley 7.

Figure 3:
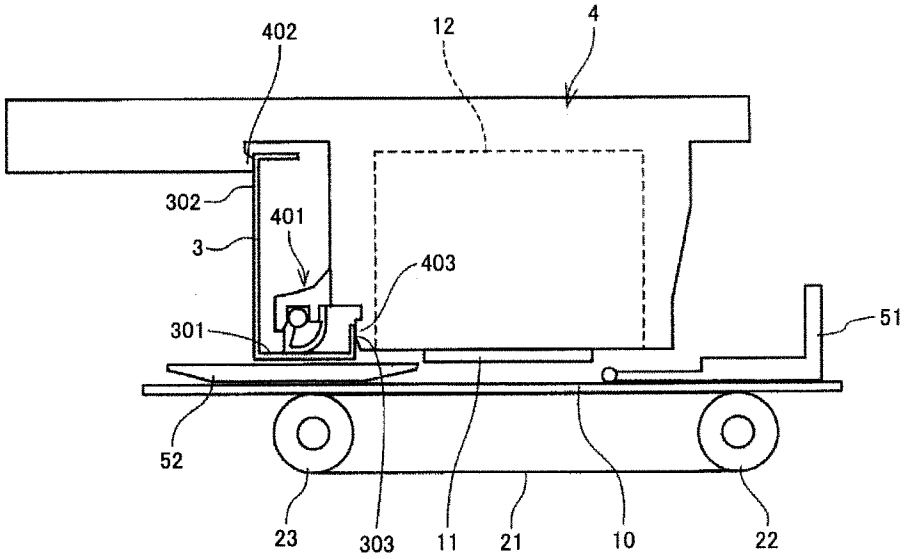
FIG. 3 is a side view of a carriage portion of the image forming apparatus.

As is shown in FIG. 3, the guide member 3 that guides the moving carriage 4 is a plate member that, includes a guide face 301, which constitutes a support face for guiding the carriage 4 along the main scanning direction, and guide faces 302, 303.

The carriage 4 includes a height adjusting part 401 that is supported by the guide face 301 of the guide member 3, a contact part 402 that comes into contact with the guide face 302, and a contact part 403 that comes into contact with the guide face 303. In this way, a so-called rod-less type guiding mechanism is realized.

The carriage 4 also includes recording heads 11*a*, 11*b* (collectively referred to as "recording head 11") made up of liquid discharge heads for discharging liquid droplets in the colors yellow (Y), cyan (C), magenta (Ni), and black (K). The recording head 11 has nozzles arranged into nozzle rows extending in the main scanning direction and a sub scanning direction, which is perpendicular to the main scanning direction. The recording head is loaded in the carriage 4 so that liquid may be discharged in a downward direction.

The recording heads 11*a* and 11*b* each have two nozzle rows, and the four nozzle rows are arranged to discharge liquid droplets in the colors Y, Ni, C, and K.

The recording heads 11*a* and 11*b* are each integrated with head tanks 12*a* and 12*b* that supply ink to the recording heads 11*a* and 11*b*. The head tanks 12*a* and 12*b* may receive an ink supply from a main tank corresponding to a replaceable ink cartridge (not shown).

As is shown in FIG. 2, an encoder scale 15 is arranged along the main scanning direction of the carriage 4, and an encoder scale sensor 16 is arranged at the side of the carriage 4 facing the encoder scale 15. The encoder scale sensor 16 is a transmission-type photo sensor that reads the scale (position identification part) of the encoder scale 15. The encoder scale 15 and the encoder scale sensor 16 realize a linear encoder corresponding to a position detection device.

Also, a transport belt 21 for transporting paper (not shown) in the sub scanning direction is arranged at the bottom side of the carriage 4. The transport belt 21 is an endless belt that is arranged around a transport roller 22 and a tension roller 23. The transport belt 21 may be moved along a loop path by a sub scanning motor 31 that rotates the transport roller 22 via a timing belt 32 and a timing pulley 33.

As is shown in FIG. 3, paper guide members 51, 52 are arranged at the upstream side and downstream side of the transport belt 21.

As is shown in FIG. 2, a maintenance unit 41 for maintaining and restoring the recording head 11 is arranged at one side of the carriage 4 in the main scanning direction at the lateral side of the transport belt 21. The maintenance unit 41 may include a suction cap 42*a* and a moisture retention cap 42*b* for capping a nozzle surface of the recording head 11 (surface on which the nozzles are formed), a wiper member 43 for wiping the nozzle surface, and an idle discharge receiver 44 that receives liquid droplets (waste liquid) discharged during idle discharge operations that are unrelated to image formation, for example. The suction cap 42*a* is connected to a suction pump 45 (see FIG. 4).

As is shown in FIG. 1, a paper tray 103 is detachably mounted to the apparatus main frame 100. The paper tray 103 includes paper feeding means for feeding paper to the transport belt 21 and paper delivery means for delivering paper on which an image has been formed by the recording head 11 discharging liquid droplets.

In the image forming apparatus described above, an image may be formed on paper fed to the apparatus by intermittently transporting the paper by the transport belt 21 and driving the recording head 11 according to an image signal while moving the carriage 4 in the main scanning direction. The recording head 11 may be controlled to discharge liquid droplets on the paper when it is at a standstill to record one line, after which the paper may be transported by a predetermined amount so that the recording head 11 may record the next line on the paper. After an image is formed on the paper by repeating the above line recording operations, the paper may be delivered to the paper tray 103.

In the case of performing maintenance operations to restore the nozzles of the recording head 11, the carriage 4 is moved to a home position facing the maintenance unit 41. Then, the nozzles may be capped and nozzle suction operations may be performed by the suction cap 42*a*, and/or idle discharge operations may be performed by discharging liquid droplets (waste liquid) unrelated to image formation to the idle discharge receiver 44. By performing such maintenance operations, stable liquid discharge operations may be ensured when forming an image, for example.

In the following, a portion of the image forming apparatus related to waste liquid processing is described with reference to FIGS. 4-6.

Figure 4:
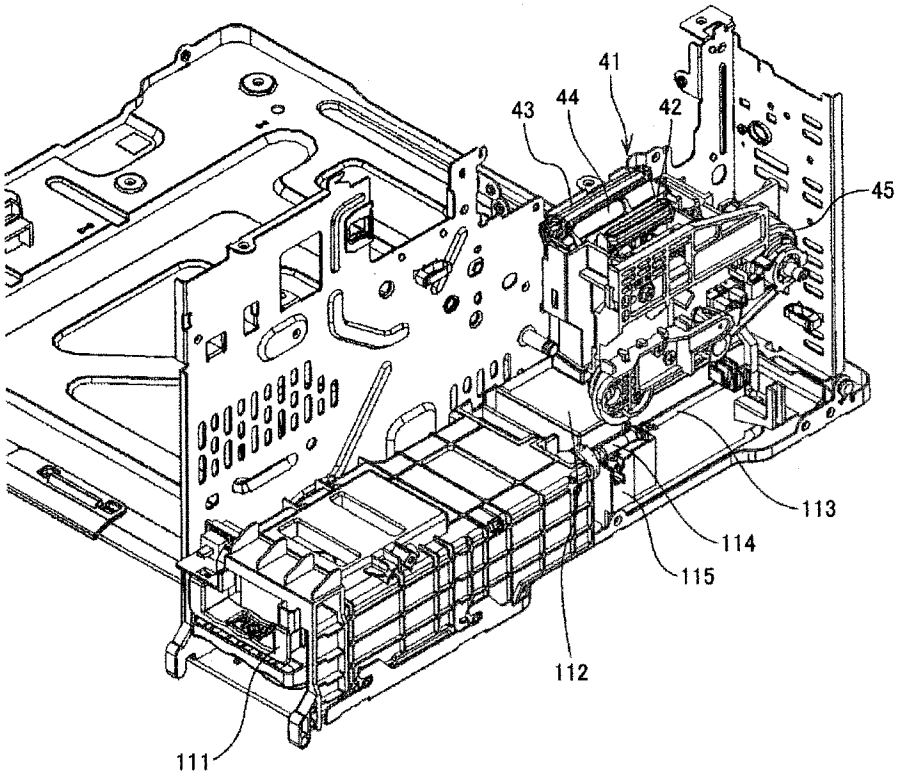
FIG. 4 is a perspective view of a portion of the image forming apparatus related to waste liquid processing.

FIG. 4 is a perspective view of the relevant portion of the image forming apparatus; FIG. 5 is another perspective view of the relevant portion; and FIG. 6 is a perspective view of a waste liquid tank.

Figure 5:
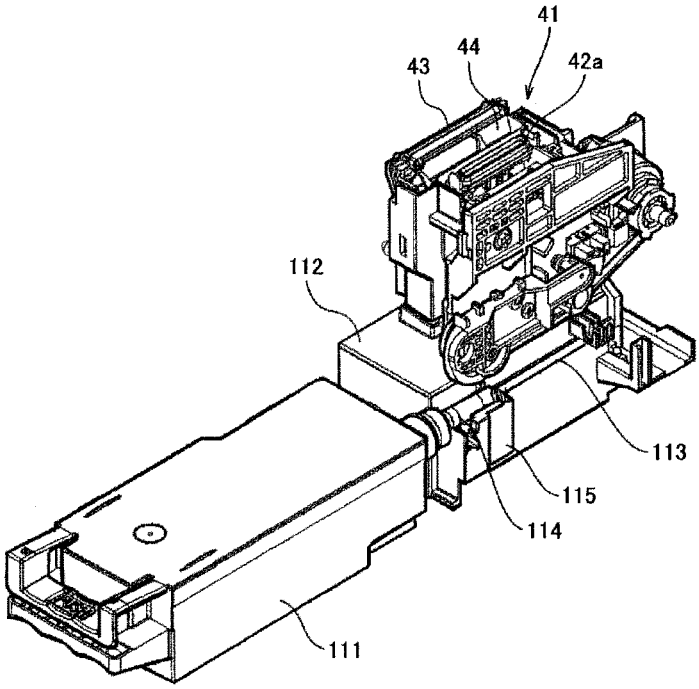
FIG. 5 is another perspective view of the portion of the image forming apparatus related to waste liquid processing.
Figure 6:
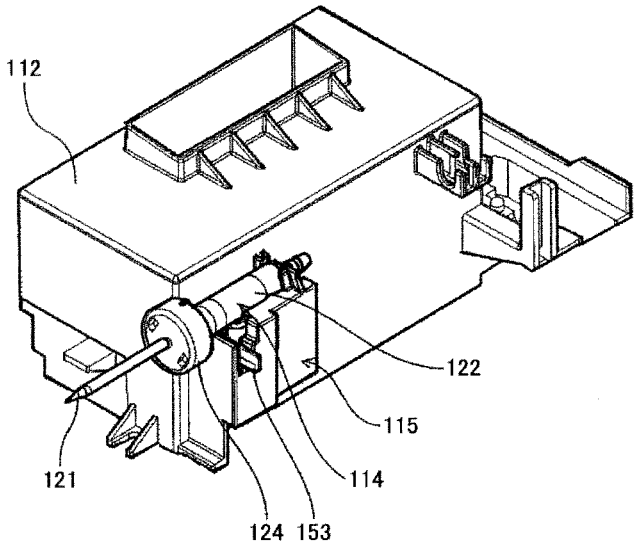
FIG. 6 is a perspective view of a waste liquid tank.

As is shown in FIGS. 4 and 5, the image forming apparatus includes a first liquid tank 111 that accommodates liquid unrelated to image formation (waste liquid) that is discharged by the suction cap 42*a*, which corresponds to a waste liquid receiving member of the maintenance unit 41, and a second waste liquid tank 112 that accommodates waste liquid discharged to the idle discharge receiver 44, which also corresponds to a waste liquid receiving member of the maintenance unit 41.

The first waste liquid tank 111 is arranged to be replaceable. The second waste liquid tank 112 is fixed to the apparatus main frame 100.

The suction cap 42*a* of the maintenance unit 41 and the first waste liquid tank 111 are connected to each other via a discharge tube 113 and a needle member 114. It is noted that the discharge tube 113 may constitute a waste liquid path having the suction pump 45 arranged midstream.

The needle member 114 is detachably fastened to a fastening member 115 that is arranged at the second waste liquid tank 112. It is noted that the fastening member 115 may be an integral part of the second waste liquid tank 112, or a separate part from the second waste liquid tank 112.

In the following, the needle member 114 and the fastening member 115 are described in greater detail with reference to FIGS. 7-17.

Figure 7:
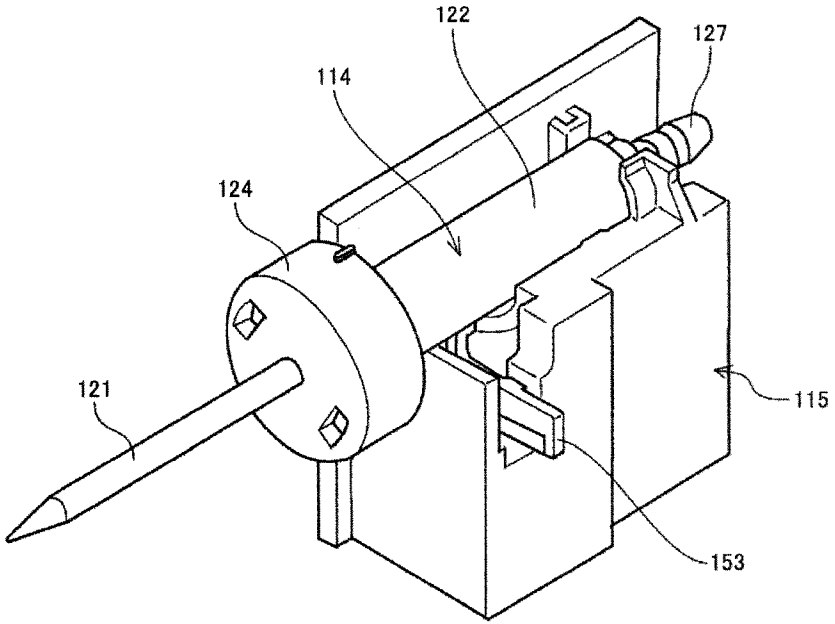
FIG. 7 is a perspective view of a needle member fastened to a fastening member.
Figure 8:
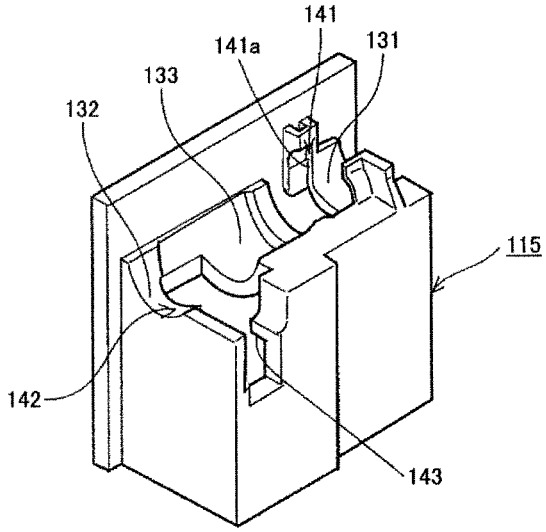
FIG. 8 is a perspective view of the fastening member.
Figure 9:
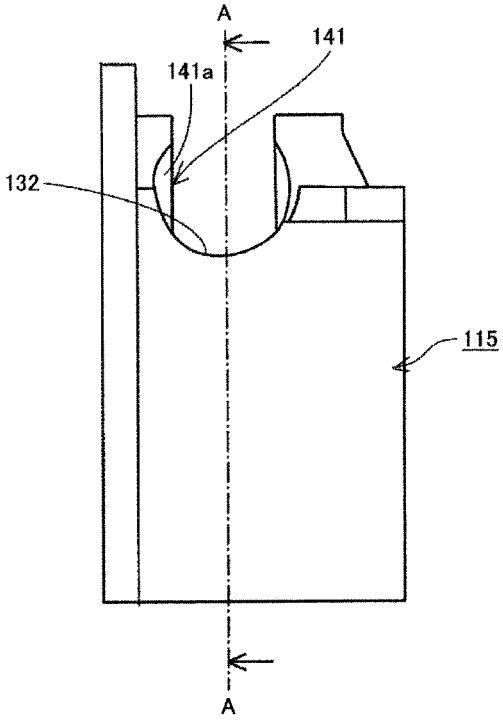
FIG. 9 is a left side view of the fastening member.
Figure 10:
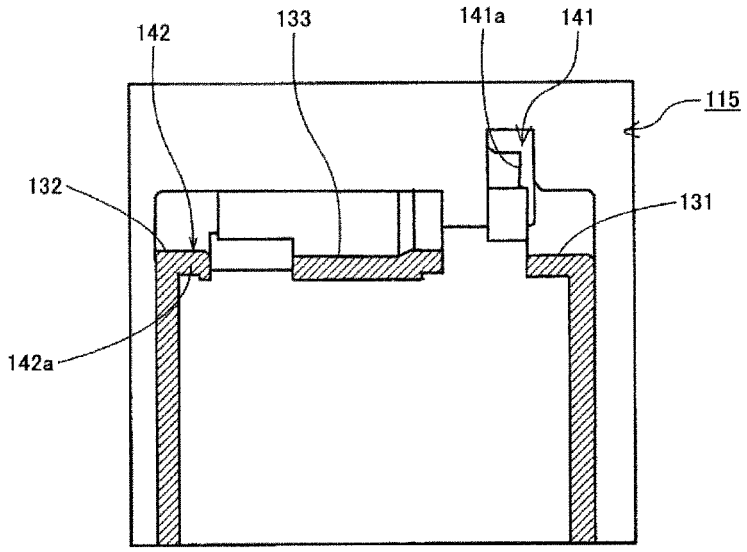
FIG. 10 is a cross-sectional view of the fastening member from section A-A of FIG. 9.
Figure 11:
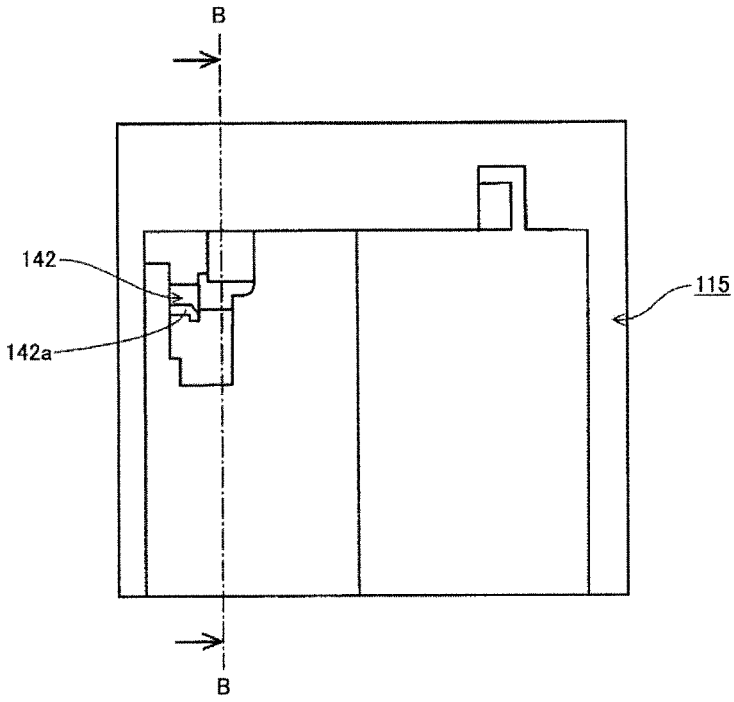
FIG. 11 is a front view of the fastening member.
Figure 12:
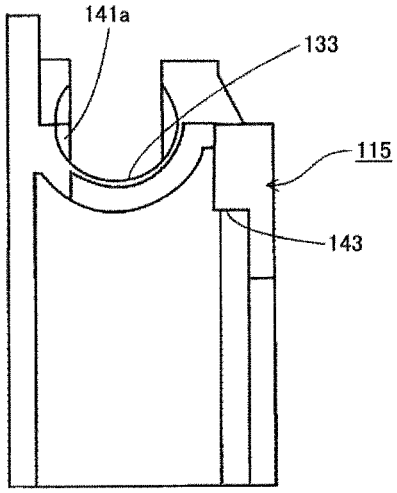
FIG. 12 is a cross-sectional view of the fastening member from section B-B of FIG. 11.
Figure 13:
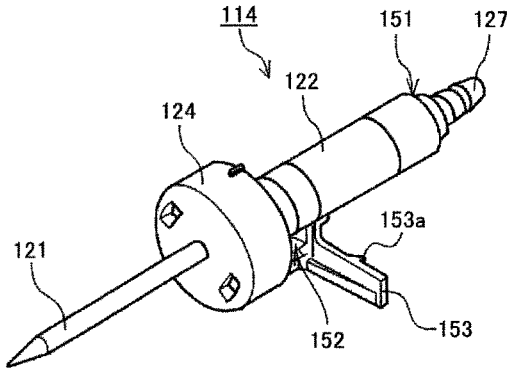
FIG. 13 is a perspective view of the needle member.
Figure 14:
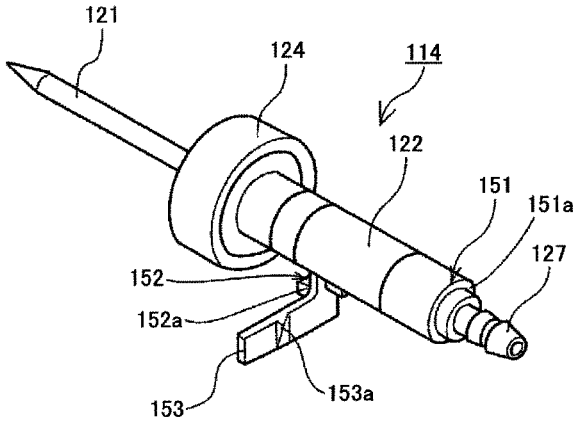
FIG. 14 is another perspective view of the needle member from the opposite side of FIG. 13.
Figure 15:
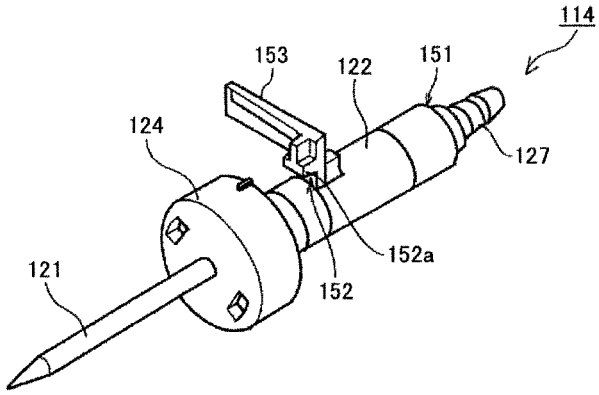
FIG. 15 is another perspective view of the needle member 114 rotated 180 degrees from the orientation shown in FIG. 13.
Figure 16:
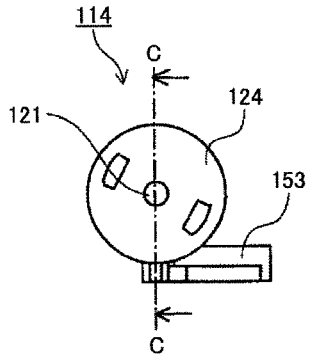
FIG. 16 is a left side view of the needle member 114.
Figure 17:
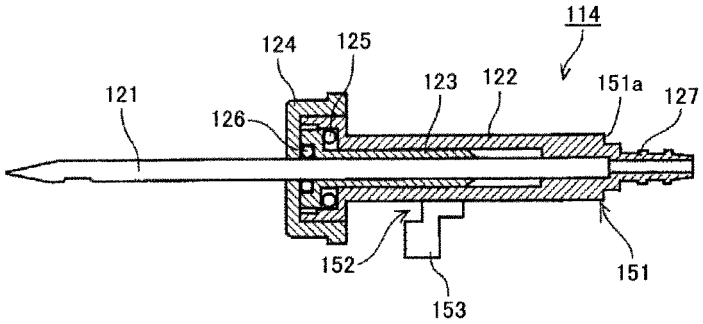
FIG. 17 is a cross-sectional view of the needle member 114 from section C-C of FIG. 16.

FIG. 7 is a perspective view of the needle member 114 fastened to the fastening member 115; FIG. 8 is a perspective view of the fastening member 115; FIG. 9 is a left side view of the fastening member 115; FIG. 10 is a cross-sectional view of the fastening member 115 from section A-A of FIG. 9; FIG. 11 is a front view of the fastening member 115; FIG. 12 is a cross-sectional view of the fastening member 115 from section B-B of FIG. 11; FIG. 13 is a perspective view of the needle member 114; FIG. 14 is another perspective view of the needle member 114 from the opposite side of FIG. 13; FIG. 15 is another perspective view of the needle member 114 rotated 180 degrees from the orientation shown in FIG. 13; FIG. 16 is a left side view of the needle member 114; and FIG. 17 is a cross-sectional view of the needle member 114 from section C-C of FIG. 16.

As is shown in FIG. 15, the needle member 114 includes a needle 121 having a hollow structure, a needle bracket 122 through which the needle 121 is inserted, and a needle bracket 123 (see FIG. 17) that is fit between the inner face of the needle bracket 122 and the outer face of the needle 121 so as to prevent the needle 121 from rotating or moving through the needle bracket 122.

The needle 121 is fastened to the needle bracket 123 at a position where a boss of the needle bracket 123 gets caught in a hole arranged at the needle 121, and the needle 121 is retained and locked in place to be prevented from moving back and forth and rotating. The needle bracket 123 is locked and prevented from rotating by fitting a rib arranged at the needle bracket 123 into a slit arranged at the needle bracket 122.

The end portion of the needle bracket 122 facing towards the first waste liquid tank 111 is fit into a cap member 124. Inside the cap member 124, a seal member 125 is fit between the inner face of the needle bracket 122 and the outer face of the needle bracket 123, and a seal member 126 is fit between the inner face of the needle bracket 123 and the outer face of the needle 121 (see FIG. 17).

The needle 121 has a connection part 127 that connects the needle 121 to the discharge tube 113 to connect the flow paths of the needle 121 and the discharge tube 113.

In the following, structural features for fastening the needle member 114 to the fastening member 115 are described.

As is shown in FIGS. 8-12, the fastening member 115 includes receiving faces 131, 132, and 133 that are configured receive the outer face of the needle bracket 122 of the needle member 114 and enable rotation of the needle member 114. The fastening member 115 also includes a first positioning part 141, a second positioning part 142, and a lock part 143.

The receiving faces 131-133 of the fastening member 115 are preferably arranged into circular arcs opening towards the upper side (as viewed from a cross-section perpendicular to the liquid flow direction of the needle member 114). It is noted that when the needle member 114 is arranged into a cylindrical structure, the needle 114 has to be inserted through the fastening member 115 so that assembly may be more burdensome.

As is shown in FIGS. 13-15, the needle member 114 includes a first positioning part 151, a second positioning part 152, and a lock lever part 153.

The first positioning part 151 of the needle member 114 corresponds to a step portion 151*a* of the needle bracket 122. It is noted that the first positioning part 141 of the fastening member 115 includes a thrust face 141*a* that is thrust against the step portion 151*a* to position the needle member 114 with respect to the liquid flow direction (referred to as "axis direction" hereinafter).

Also, it is noted that the receiving face 131, which is arranged by the first positioning portion 141, receives the outer face of the needle bracket 122 to position the needle member 114 with respect to the height direction.

The second positioning part 142 of the fastening member 115 includes a fitting part 142*a* that is arranged into a circular arc as viewed from a cross-section perpendicular to the axis direction.

The fitting part 142*a* of the second positioning part 142 of the fastening member 115 is arranged between a rib 152*a* corresponding to a fitting part of the second positioning part 152 of the needle member 114 and the outer face of the needle bracket 122 to position of the needle member 114 in the axis direction. Also, the receiving face 132, which is arranged by the second positioning part 142, receives the outer face of the needle bracket 122 of the needle member 114 to position the needle member 114 with respect to the height direction.

The lock lever part 153 of the needle member 114 rotates the needle member 114 along a cross-section perpendicular to the axis direction. The lock lever part 153 includes a protrusion 153*a* that locks with the lock part 143 of the fastening member 115 when the needle member 114 is rotated. By rotating the lock lever part 153 until the protrusion 153*a* goes over the lock part 143, the lock lever part 153 may be locked and fastened to the lock part 143.

It is noted that although the rib 152*a* of the second positioning part 152 of the needle member 114 forms an integral part of the lock lever part 153 in the illustrated example, the rib 152*a* and the lock lever 153 may be separate parts in other examples.

In the following, process steps for fastening the needle member 114 to the fastening member 115 are described with reference to FIGS. 18A-18C and FIGS. 19A-19B.

Figure 18A:
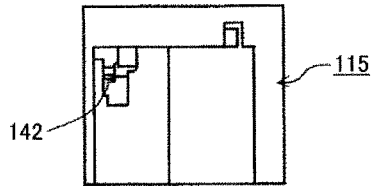
FIGS. 18A-18C are front views of the fastening member and the needle member.
Figure 18B:
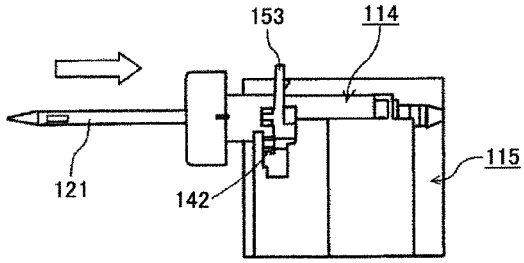
Figure 18C:
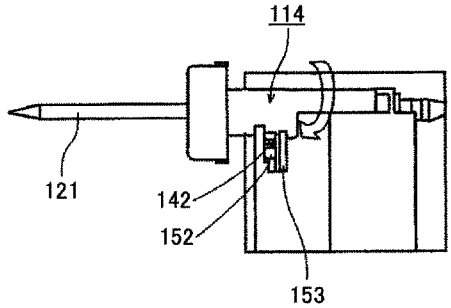
Figure 19A:
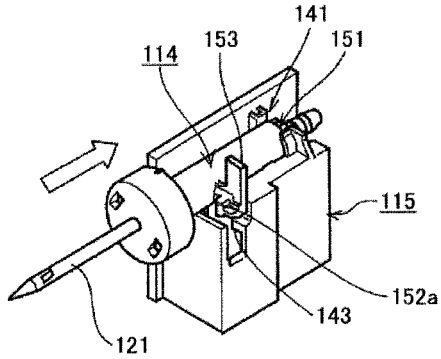
FIGS. 19A-19B are perspective views of the fastening member and the needle member.
Figure 19B:
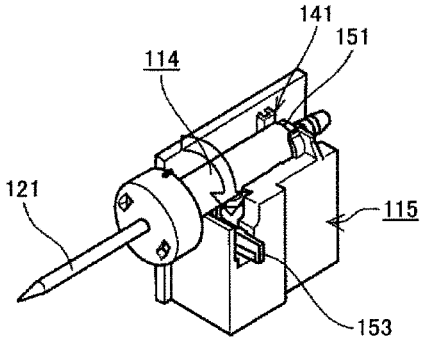

FIGS. 18A-18C are front views of the fastening member 115 and the needle member 114. FIGS. 19A-19B are perspective views of the fastening member 115 and the needle member 114.

First, to fasten the needle member 114 to the fastening member 115 shown in FIG. 18A, the needle member 114 is fit to the receiving faces 131-133 and the needle member 114 is moved in the direction of the arrows shown in FIGS. 18B and 195 so that the step part 151*a* corresponding to the first positioning part 151 of the needle member 114 is thrust against the thrust face 141*a* of the first positioning part 141 of the fastening member 115.

Then, the lock lever part 153 of the needle member 114 is rotated in the direction of the arrows shown in FIGS. 18C and 19C so that the second positioning part 142 of the fastening member 115 is fit between the outer face of the needle member 114 and the rib 152*a* of the second positioning part 152, the lock part 143 of the fastening member 115 locks with the protrusion 153*a* of the lock lever part 153, and the needle member 114 is positioned in place.

It is noted that the above process steps may be reversed in order to detach the needle member 114 from the fastening member 115.

According to an aspect of the present embodiment, the needle member 114 may be easily detached. Also, since parts for positioning the needle member 114 (e.g., first and second positioning parts 141, 142, 151, 152) and parts for fastening the needle member 114 (e.g., lock part 143, lock lever part 153) are separately provided, the needle member 114 may be accurately positioned and fastened without loosening.

In the following, a needle member according to a second embodiment of the present invention is described with reference to FIG. 20.

Figure 20:
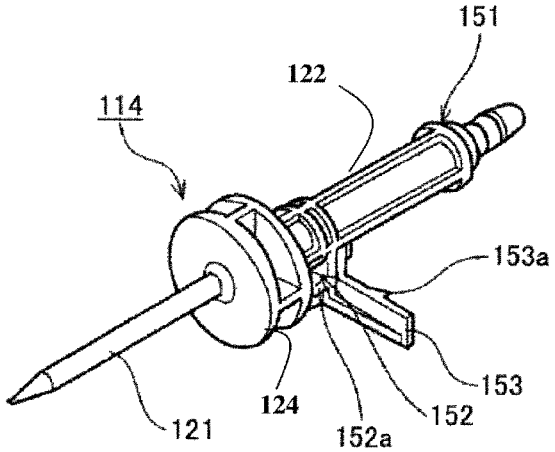
FIG. 20 is a perspective view of a needle member according to a second embodiment of the present invention.

FIG. 20 is a perspective view of the needle member 114 according to the second embodiment.

In the second embodiment, parts of the needle member 114 including the needle 121, the needle bracket (122 in first embodiment) and the cap member (124 in first embodiment) are integrally formed with resin.

In the following, a third embodiment of the present invention is described with reference to FIGS. 21-23.

Figure 21:
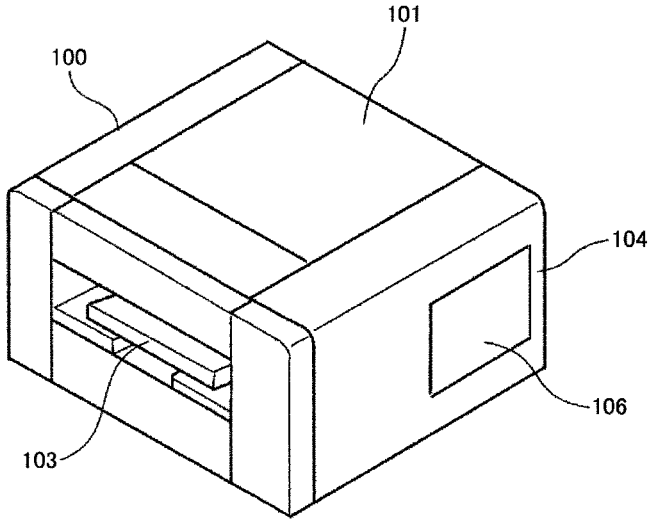
FIG. 21 is a perspective view of an image forming apparatus according to a third embodiment of the present invention.

FIG. 21 is a perspective view of an image forming apparatus according to the third embodiment; FIG. 22 is a perspective view of the image forming apparatus with a lid member 106 removed; and FIG. 23 is a perspective view of the lid member 106.

The image forming apparatus according to the third embodiment includes an outer cover 104 having an opening 105 at a location opposite the needle member 114 and the fastening member 115. The opening 105 is covered by the lid member 106 that is arranged to be removable and may be opened and closed.

Figure 22:
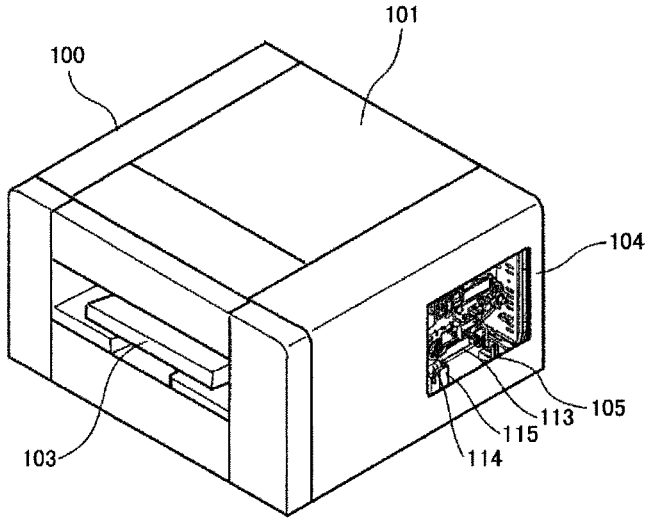
FIG. 22 is a perspective view of the image forming apparatus with a lid member removed.
Figure 23:
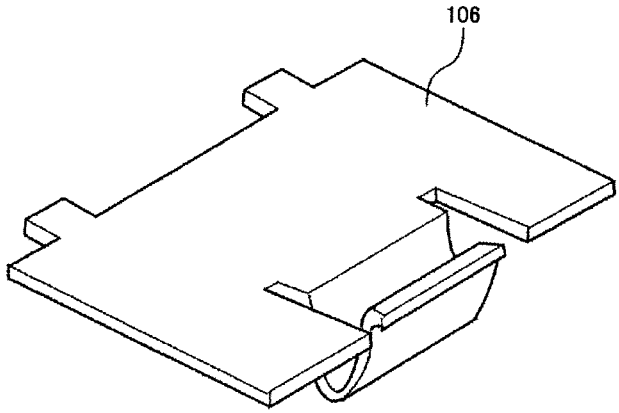
FIG. 23 is a perspective view of the lid member.

According to an aspect of the present embodiment, the needle member 114 may be easily detached or fastened by removing (or opening) the lid member 106 as is shown in FIG. 22.

It is noted that the term "paper" as used in the above descriptions is not limited to a medium made of paper, but more broadly encompasses any type of medium on which liquid such as ink droplets may be adhered including an OHP (overhead projector) film, cloth, glass, and a substrate, for example. Moreover, the term generally encompasses any material that may be referred to as a recording medium, a recording sheet, or recording paper, for example. Also, it is noted that the terms "image formation," "recording," and "printing" are used synonymously in the above descriptions.

The term "image forming apparatus" is used to refer to an apparatus that forms an image by discharging liquid on a medium including paper, thread, fiber, cloth, leather, metal, plastic, glass, wood, and ceramic, for example. The term "image formation" is not limited to the rendering of an image having meaning such as a character or a figure, but also encompasses the rendering of an image without meaning such as a pattern (e.g., simply dropping liquid droplets on a medium), for example.

The term "ink" as used in the above descriptions is not limited to what is typically referred to as ink, but more broadly encompasses any type of liquid that may be used as an image forming agent including any type of recording liquid or fixing liquid such as DNA samples, resist materials, patterning materials, and resins, for example.

The term "image" as used in the above descriptions is not limited to a planar image and also encompasses an image rendered on a three-dimensional medium as well as an image of a three-dimensional object that is formed using a three-dimensional model, for example.

Further, the present invention is not limited to these embodiments, and numerous variations and modifications may be made without departing from the scope of the present invention.

The present application is based on and claims the benefit of the priority date of Japanese Patent Application No. 2011-265307 filed on Dec. 2, 2011, with the Japanese Patent Office, the entire contents of which are hereby incorporated by reference.

What is claimed is:

1. An image forming apparatus comprising:

a recording head that discharges liquid droplets;

a waste liquid receiving member that receives waste liquid that is discharged from the recording head for a purpose unrelated to image formation;

a waste liquid tank that accommodates the waste liquid received by the waste liquid receiving member;

a needle member that is connected to the waste liquid receiving member and includes a needle part that is detachably inserted into the waste liquid tank; and a fastening member that is fixed at an apparatus main frame and is configured to detachably fasten the needle member to the apparatus main frame; wherein the fastening member includes a lock part that locks the needle member and receiving faces that are arranged into circular arcs opening towards an upper side when viewed as a cross-section perpendicular to a liquid flow direction of the needle member;

the needle member includes a lock lever part that locks with the lock part of the fastening member;

the needle member includes a connection part that connects the needle part to a discharge tube to connect flow paths of the needle part and the discharge tube respectively;

the lock lever of the needle member is disposed to rotate the needle member along a cross-section perpendicular to the axis direction, and the lock lever part includes a protrusion that locks with the lock part of the fastening member, and when the needle member is rotated by the lock lever part until the protrusion goes over the lock part, the lock lever part is locked and fastened to the lock part;

the needle member and the fastening member include fitting parts that fit together when the needle member is rotated;

the fitting part of the fastening member is arranged into a circular arc when viewed as a cross-section perpendicular to the axis direction; and by rotating the needle member, the fitting parts of the needle member and the fastening member are fit together.

2. The image forming apparatus as claimed in claim 1, wherein the needle member includes a step part that is arranged at an end portion; and the fastening member includes a thrust face that thrusts against the step part and positions the needle member in a waste liquid flow direction.

3. The image forming apparatus as claimed in claim 1, wherein the fitting part of the fastening member is fit between the fitting part of the needle member and an outer face of the needle member.

4. The image forming apparatus as claimed in claim 1, wherein the waste liquid tank includes a first waste liquid tank that is arranged to be detachable from an apparatus main frame and a second waste liquid tank that is fixed to the apparatus main frame; and the fastening member is arranged at the second waste liquid tank and the needle member is arranged to connect the first waste liquid tank to the waste liquid receiving member.

5. An image forming apparatus comprising:

a recording head that discharges liquid droplets;

a waste liquid receiving member that receives waste liquid that is discharged from the recording head for a purpose unrelated to image formation;

a waste liquid tank that accommodates the waste liquid received by the waste liquid receiving member;

a needle member that is connected to the waste liquid receiving member and includes a needle part that is detachably inserted into the waste liquid tank; and a fastening member fixed at an apparatus main frame that is configured to detachably fasten the needle member to the apparatus main frame; wherein the fastening member includes a lock part that locks the needle member and receiving faces that are arranged into circular arcs opening towards an upper side when viewed as a cross-section perpendicular to a liquid flow direction of the needle member;

the needle member includes a lock lever part that locks with the lock part of the fastening member;

the needle member includes a connection part that connects the needle part to a discharge tube to connect flow paths of the needle part and the discharge tube, respectively;

the lock lever part of the needle member is disposed to rotate the needle member along a cross-section perpendicular to the axis direction, and the lock lever part includes a protrusion that locks with the lock part of the fastening member, and when the needle member is rotated by the lock lever part until the protrusion goes over the lock part, the lock lever part is locked and fastened to the lock part;

the needle member and the fastening member include respective fitting parts that fit together when the needle member is rotated;

the fitting part of the fastening member is arranged into a circular arc when viewed as a cross-section perpendicular to the axis direction;

the fitting parts of the needle member and the fastening member are fit together by rotating the needle member; and the fitting part of the needle member is arranged at the lock lever part.

* * * * *